US005671482A

United States Patent [19]

Alvera

[11] Patent Number: 5,671,482

[45] Date of Patent: Sep. 30, 1997

[54] STOCKING HAVING A COMFORT FOOT AREA

[76] Inventor: Lee A. Alvera, 4002 42nd St. SW., Grandville, Mich. 49418

[21] Appl. No.: 322,450

[22] Filed: Oct. 11, 1994

[51] Int. Cl.[6] ..... A41B 11/02

[52] U.S. Cl. ..... 2/241; 2/239; 139/383 R

[58] Field of Search ..... 139/383 R, 383 B, 139/384 R, 387 R, 388; 66/178 R, 179, 180, 181, 183, 186, 187; 2/239, 240, 241, 242

[56] References Cited

U.S. PATENT DOCUMENTS

| | | | |
|---|---|---|---|
| 1,942,152 | 1/1934 | Sauer | 2/239 |
| 2,010,936 | 8/1935 | Van Arsdale et al. | 2/239 |
| 2,325,977 | 8/1943 | Pickels et al. | 2/239 |
| 2,798,281 | 7/1957 | Herzog | 2/239 |
| 3,013,564 | 12/1961 | Levey | 2/241 |
| 4,240,160 | 12/1980 | Imboden | 2/239 |
| 4,856,110 | 8/1989 | Giesick | 2/239 |

OTHER PUBLICATIONS

Glossary of Sock and Sheer Hosiery Terms, Nat'l Ass'n of Hosiery Manufacturers, Charlotte, NC, p. 7 (1994).

Package from Acme-McCrary, Asheboro, NC Entitled "Style 592, Support Cotton Sole Knee High" (Oct. 1996).

*Primary Examiner*—C. D. Crowder
*Assistant Examiner*—Larry D. Worrell, Jr.
*Attorney, Agent, or Firm*—Young & Basile, P.C.

[57] ABSTRACT

Described is a stocking having a comfort foot area. The comfort area encompasses the toe, sole and heel areas of the foot. A pad is sized to cover and be secured to the comfort area or integrally woven into the comfort area to act as a liner to protect and comfort the foot of the wearer of the stocking. The pad is made out of a thicker, absorbent fiber material to absorb wetness and allow the foot to breathe.

3 Claims, 4 Drawing Sheets

STOCKING HAVING A COMFORT FOOT AREA

BACKGROUND OF THE INVENTION

1. Field of the Invention

This invention relates to footwear and in particular, the invention relates to a nylon stocking that has cotton or the like, integrally woven, within the nylon on the toe, sole and heel area.

2. Description of the Prior Art

In the construction of a typical nylon type stocking, there is a single material from the leg of the user down to the toe. Modern dress codes, as implicit as they are, require women to wear nylon type hosiery whenever they wear a dress or skirt. The soles of the hosiery, although often doubled or tripled in thickness, are still normally uncomfortable. The nylon tends to slip and slide within the shoe and does not have much absorbency for perspiration.

Nylon or the like stockings are also worn by both men and women for medical reasons such as varicose veins, gout or poor circulation. These stockings are typically worn underneath pants and the user puts conventional socks over the stockings before putting on shoes.

Many manufacturers have tried to improve on this discomfort and support problem in the field of socks. Some have added leather or suede soles over the existing cloth whereas others have put inserts of polyurethane, polyester or plastic foam inside the stocking.

Many of these prior art inventions have improved the user's predicament, but have not relieved the problem of slippage in the shoe, or have added a problem of creating an uncomfortable bulk within the shoe of the wearer.

The prior art patents have dated back to 1906 where J. J. Lepper U.S. Pat. No. 832,550 discloses a sock with a combined insole and retaining device. The retaining device is inserted into a standard hose or sock and allows the user to use a medicated pad to prevent or heal callouses, corns and the like. The device can also be worn on the outside of the hose, but in either case, is separate from the hose.

U.S. Pat. No. 4,852,272 issued to Chilewich adhered a suede sole to a slipper sock by sewing the suede over a conventional sock. This is an improvement over Lepper, but because of the bulk, is not easily wearable inside a shoe.

While many of these earlier patents were directed to structures which improve the comfort and wearability of a sock or slipper sock, none of these patents teach a fully satisfactory structure for being able to wear the sock in a dress shoe, or being able to use the insert with nylon-type hosiery.

Other sock or hosiery patents, such as U.S. Pat No. 1,293,399 issued to Fry; U.S. Pat. No. 2,319,577 issued to Bard, and U.S. Pat No. 1,106,208 issued to Hale, teach other sock and hosiery construction which incorporate one or more features of a stocking having a comfort area. None, however, teach the construction of the present invention which is more comfortable in use because of the unique and novel combination of features.

Foreign Patents such as Nos. 240,178 and 955,048 from the United Kingdom, and Patent Nos. 1.288.805 and 1.361.146 from France all discuss improved socks or slippers. None teach having a conventional nylon-like hosiery for the upper portion of the garment and a thicker, more comfortable type of material used on the lower, sole area of the sock or stocking.

Numerous innovations for stockings have been provided in the prior art that are described as follows. Even though these innovations may be suitable for the specific individual purposes to which they address, they differ from the present invention as hereinafter contrasted.

In U.S. Pat. No. 4,277,959 titled: Socks with Integrally Knit Cushions in Heel, Arch and Ball by inventor James L. Thorneburg, athletic socks are particularly suitable for jogging and running and are provided with shock absorber cushion pads in the heel (11), ball (15), and in the inner portion (16a) of the arch area (16) and being formed by a sufficiently greater amount of yarn being knit in these portions than the amount of yarn knit in the outer portion of the arch (16b). The shock absorber cushion pads protect and cushion the heel, ball and inner portion of the arch of the wearer's foot and reduce the shock normally imparted to the heel, ball and inner portion of the arch of the foot so that normal articulation of the bones in the feet takes place when the wearer is jogging and running. The shock absorber cushion pads are illustrated as being formed by providing a greater density of terry loops in the heel (11), ball (15), and inner portion (16a) of the arch than in the outer portion (16b) of the arch to enhance the cushioning provided in the corresponding portions of each sock.

The above referenced prior art is designed specifically for the athletic sock in mind by reinforcing specific areas of the sock, whereas the present invention is designed for any person who wants or needs added comfort or support from his or her stocking, i.e. nylons, while being able to wear a dress or dress clothes.

In U.S. Pat. No. 5,133,088 titled Sock Pad and Method by inventor Albert R. Dunlap, ink rises upon setting (curing) to form a friction producing surface on the back of the sock above the heel. The printed surface prevents the sock from sliding into the shoe during periods of exercising such as walking, jogging or other physical activities.

This prior art patent utilizes a formable or "puff" ink to form a friction producing surface on the back of the sock above the heel. The present invention, in contrast, utilized a comfort material such as cotton or the like integrally woven within the sole of the stocking. The present invention, also, improves on the comfort of the user's feet as well as the decrease in slippage in the shoe.

In U.S. Pat. No. 4,373,361 titled Ski Sock with Integrally Knit Thickened Fabric Areas by inventor James L. Thorneburg, each embodiment of the ski sock of the present invention includes additional yarn knit in plated relationship with the body yarns to form a thickened fabric area extending down the front portion of the leg of the sock to cushion and protect the front portion of the leg of the wearer from discomfort caused by the front and upper edge of the ski boot. The ski sock also includes a thickened fabric area extending along the rear half of the sock and at least through the heel and sole area to cushion and protect the heel and lower portion of the foot of the wearer. Opposite side panels of thinner fabric are provided between the thickened fabric areas in the front and rear of the sock to reduce the bulk of the fabric. The thinner fabric areas may provide increased stretchability to these areas and to permit the sock to be easily drawn onto and off of the foot and to readily conform to the foot of the wearer. Stretch restricting opposite side panels are provided in the lower portion of the foot, that portion of the foot adapted to fit over the forward portion of the foot and up to the medial portion of the ball of the foot, to limit the stretchability and to provide a snug fit on the forward end of the foot of the wearer.

The above referenced prior art is designed specifically for the ski sock by reinforcing specific areas of the sock, whereas the present invention is designed for any person who wants or needs added comfort, absorbency or support from his or her stocking, i.e. nylons, while being able to wear a dress clothes and dress clothes.

In U.S. Pat. No. 4,216,662 titled Cushion Stitch Construction for Men's Hosiery by inventors J. Nimrod Harris, Jr. and Willie M. Howell, a circular knit sock has a leg and upper foot portion knitted from a body yarn in a conventional stitch pattern, and a lower foot portion knitted from a combination of the body yarn and an auxiliary or reinforcement yarn of a second fiber content in a cushion stitch which has: (1) a first set of alternating courses knitted from the body yarn; (2) a second set of alternating courses knitted from a combination of the body and reinforcement yarns; (3) a first set of alternating wales formed of plain stitch loops made from a combination of the body yarn and the auxiliary yarn; and (4) a second set of alternating wales formed of successive tuck stitches made from the combined auxiliary and body yarns of one course and the body yarn of the preceding or adjacent course.

The above referenced prior art is designed specifically for men's hosiery for added cushioning in dress socks. The present invention, in contrast, is primarily geared for fine hosiery such as nylons.

In U.S. Pat. No. 4,615,188 titled Two-Ply Athletic Sock by inventors David F. Hursh, James B. Johnston, Frank Ko and Jeffrey W. Bruner, a knit sock, especially for jogging or other athletic activity, has a foot portion consisting of a first inner layer or ply disposed inside a second outer layer or ply. The first ply of the foot portion has an inner surface adapted to contact the skin formed principally of yarns having high fictional characteristics, high thermal conductivity, and low moisture regain (hydrophobic). Its opposed surface is formed principally of yarns having relatively low frictional characteristics. The second ply has an inner surface which has low fictional characteristics and its outer surface is formed of yarns having relatively high fictional characteristics and high moisture regain (hydrophilic). The latter surface may also be formed with terry loops to enhance its shock-absorbing construction as well as to increase its moisture absorbing capacity.

The above referenced prior art is designed especially for jogging or other athletic activity for added shock absorbency and moisture absorbency. The present invention, in contrast, is primarily geared for fine hosiery such as nylons.

SUMMARY OF THE INVENTION

In accordance with the invention, a stocking having a comfort foot area, is provided. The invention is fine hosiery, such as nylon, with the sole having a more comfortable material, such as cotton, integrally weaved throughout. It is typically constructed as two separate parts integrally woven together.

The present invention provides walking comfort to the wearer of the stocking, while being, at the same time, durable, more resilient to chemical auto deterioration in the presence of normal or abnormal excretion and exhalation of the epidermis than that of nylon alone.

The typical nylon or synthetic hosiery is of the same material all down the leg and over the foot. The present invention replaces or integrally weaves the foot area with a more comfortable type of material such as cotton or wool. This material has a cushioning effect on the foot along with greater absorbency of perspiration.

The ability to wear this hosiery all day while helping reduce the likelihood of developing callouses or medical problems is a great advantage to most females who are required to wear nylons with dresses, or men or women who are required to wear nylons because of health reasons.

Accordingly, it is an object of the present invention to provide a stocking that is comfortable and simple to use.

More particularly, it is an object of the present invention to provide a stocking that looks exactly like a conventional stocking while the user has his or her shoes on.

A further object of the present invention is to provide a method of weaving the cushioning fabric, such as cotton or wool, into the nylon as not to overly increase the overall bulk of the stocking.

Still another object of the present invention is to provide a stocking that will decrease the sliding and slippage due to the nature of the nylon, of the user's feet inside of their shoe.

A still further object is to provide a stocking having a comfort area that is economical in cost to manufacture.

In keeping with these objects, and with others which will become apparent hereinafter, one feature of the present invention resides, briefly stated, in the absorbent fiber pad woven or sewn into the foot area covering the heal, sole and toe areas absorbing wetness and allowing the foot to breathe.

In accordance with another feature of the present invention, is the pad acting as a liner to protect and comfort the bottom of a foot of a wearer of the stocking.

Still another feature of the present invention is the ability of the wearer to wear dress clothes and dress shoes while wearing the stockings. Further variations of the comfort area may be required for certain dress shoes, for example, a stocking having a comfort area consisting of only the ball and toe areas of the sole to be worn with open-backed shoes.

The novel features which are considered characteristic for the invention are set forth in the appended claims. The invention itself, however, both as to its construction and its method of operation, together with additional objects and advantages thereof, will be best understood from the following description of the specific embodiments when read and understood in connection with the accompanying drawings.

BRIEF LIST OF REFERENCE NUMERALS UTILIZED IN THE DRAWING

10—stocking having a comfort foot area 10
12—nylon stocking 12
12A—nylon stocking vertical threads 12A
12AA—nylon stocking vertical threads under crossing 12AA
12B—nylon stocking horizontal threads 12B
12BA—nylon stocking horizontal threads under crossing 12BA
14—stocking sole 14
14A—stocking sole left diagonal threads 14A
14AA—stocking sole left diagonal threads loop crossing 14AA
14B—stocking sole right diagonal threads 14B
14BA—stocking sole right diagonal threads loop crossing 14BA

DETAILED DESCRIPTION OF THE PREFERRED EMBODIMENT

Figure 1:
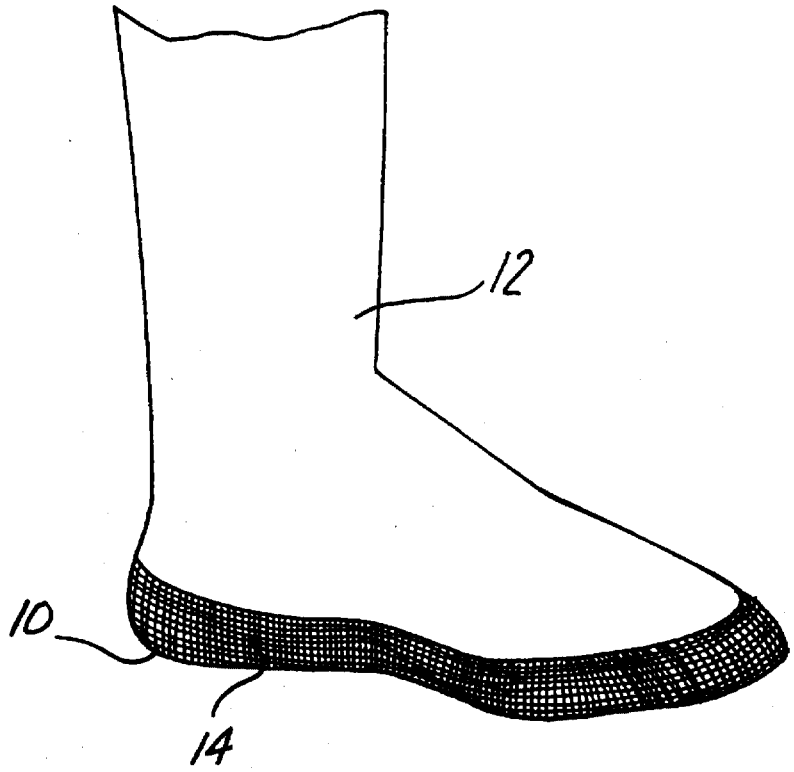
FIG. 1 is a side view of the stocking having a comfort foot area.

Firstly, referring to FIG. 1 showing a side view of the stocking having a comfort foot area, exhibiting the following features: stocking having a comfort foot area 10 comprising: a nylon stocking 12 having nylon stocking vertical threads 12A and nylon stocking horizontal threads 12B, and a stocking sole 14 having stocking sole left diagonal threads 14A and stocking sole right diagonal threads 14B interweaved into the nylon stocking; nylon stocking 12 having nylon stocking vertical threads 12A and nylon stocking horizontal threads 12B weaving together forming a conventional nylon legging; and stocking sole 14 connecting with the nylon stocking 12 by integrally weaving the nylon stocking vertical threads 12A and nylon stocking horizontal threads 12B with the stocking sole left diagonal threads 14A and the stocking sole right diagonal threads 14B.

Figure 2:
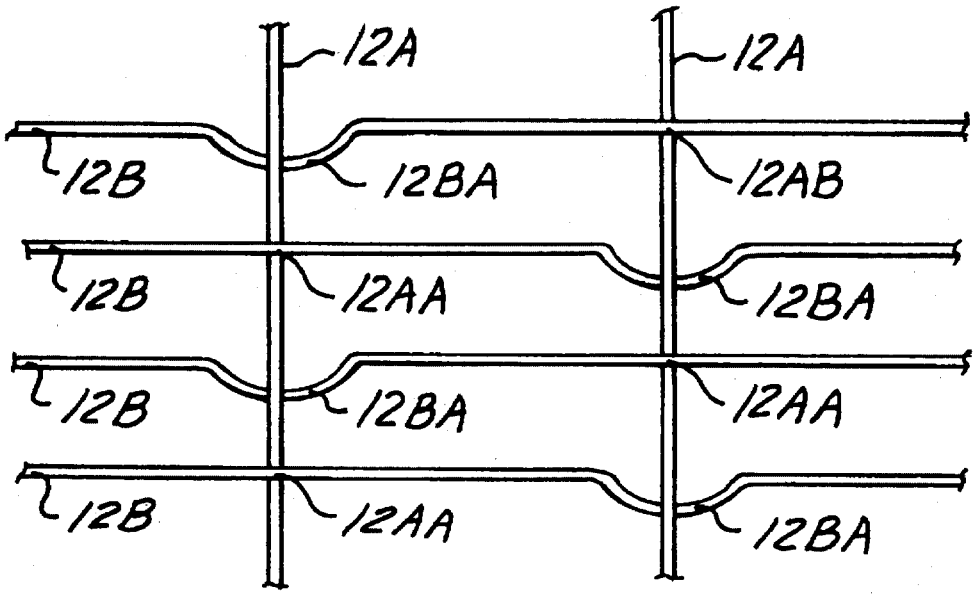
FIG. 2 is a magnified showing of the normal weave of the nylon.

Now, referring to FIG. 2 being a magnified showing of the normal weave of the nylon, exhibiting the following features: nylon stocking 12 having nylon stocking vertical threads 12A and nylon stocking horizontal threads 12B weaving together forming a conventional nylon legging; nylon stocking vertical threads 12A weaving in a basket-weave motion between the nylon stocking vertical threads upper crossing 12AA and the nylon stocking horizontal threads upper crossing 12BA; nylon stocking vertical threads under crossing 12AA weaving under the nylon stocking horizontal threads 12B forming a basket-weave pattern; nylon stocking horizontal threads 12B weaving in a basket-weave motion between the nylon stocking vertical threads upper crossing 12AA and the nylon stocking horizontal threads upper crossing 12BA; and nylon stocking horizontal threads under crossing 12BA weaving under the nylon stocking vertical threads 12A forming a basket-weave pattern.

Figure 3:
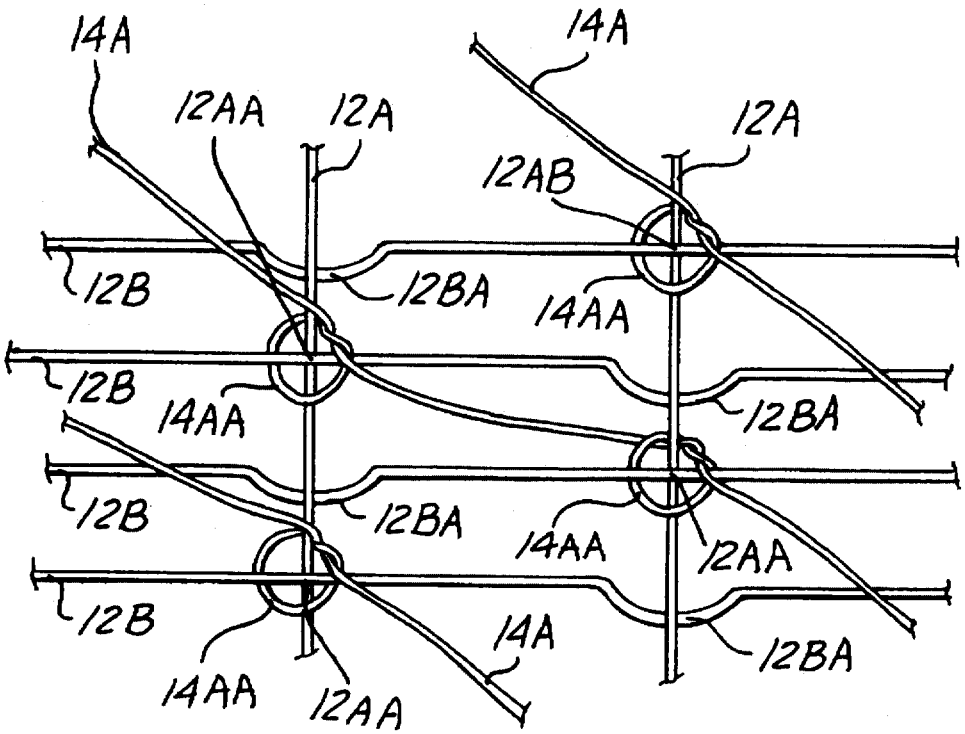
FIG. 3 is a magnified showing of the cushioning material diagonally weaved into the normal weave of the nylon.

Now, referring to FIG. 3 showing a magnified showing of the comfort material diagonally weaved into the normal weave of the nylon, exhibiting the following features: nylon stocking vertical threads 12A weaving in a basket-weave motion between the nylon stocking vertical threads upper crossing 12AA and the nylon stocking horizontal threads upper crossing 12BA; nylon stocking vertical threads under crossing 12AA weaving under the nylon stocking horizontal threads 12B forming a basket-weave pattern; nylon stocking horizontal threads 12B weaving in a basket-weave motion between the nylon stocking vertical threads upper crossing 12AA and the nylon stocking horizontal threads upper crossing 12BA; nylon stocking horizontal threads under crossing 12BA weaving under the nylon stocking vertical threads 12A forming a basket-weave pattern; stocking sole left diagonal threads 14A traversing diagonally upward in a right to left direction integrally weaving with the nylon stocking vertical threads 12A and nylon stocking horizontal threads 12B; and stocking sole left diagonal threads loop crossing 14AA fastening the stocking sole left diagonal threads 14A to the nylon stocking vertical threads 12A and the nylon stocking horizontal threads 12B at the nylon stocking vertical threads under crossing 12AA.

Figure 4:
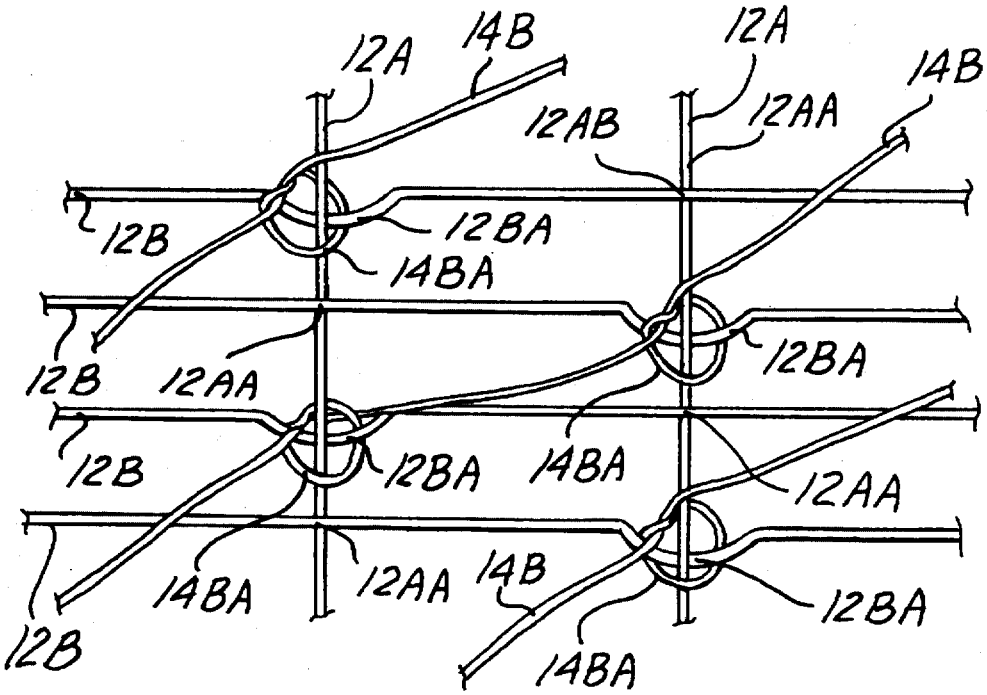
FIG. 4 is a second magnified showing of the cushioning material diagonally weaved into the normal weave of the nylon.

Now, referring to FIG. 4 showing a second magnified showing of the comfort material diagonally weaved into the normal weave of the nylon, exhibiting the following features: nylon stocking vertical threads 12A weaving in a basket-weave motion between the nylon stocking vertical threads upper crossing 12AA and the nylon stocking horizontal threads upper crossing 12BA; nylon stocking vertical threads under crossing 12AA weaving under the nylon stocking horizontal threads 12B forming a basket-weave pattern; nylon stocking horizontal threads 12B weaving in a basket-weave motion between the nylon stocking vertical threads upper crossing 12AA and the nylon stocking horizontal threads upper crossing 12BA; nylon stocking horizontal threads under crossing 12BA weaving under the nylon stocking vertical threads 12A forming a basket-weave pattern; stocking sole right diagonal threads 14B wavering diagonally upward in a left to right direction integrally weaving with the nylon stocking vertical threads 12A and nylon stocking horizontal threads 12B; and stocking sole right diagonal threads loop crossing 14BA fastening the stocking sole right diagonal threads 14B to the nylon stocking vertical threads 12A and the nylon stocking horizontal threads 12B at the nylon stocking horizontal threads under crossing 12BA.

Figure 5:
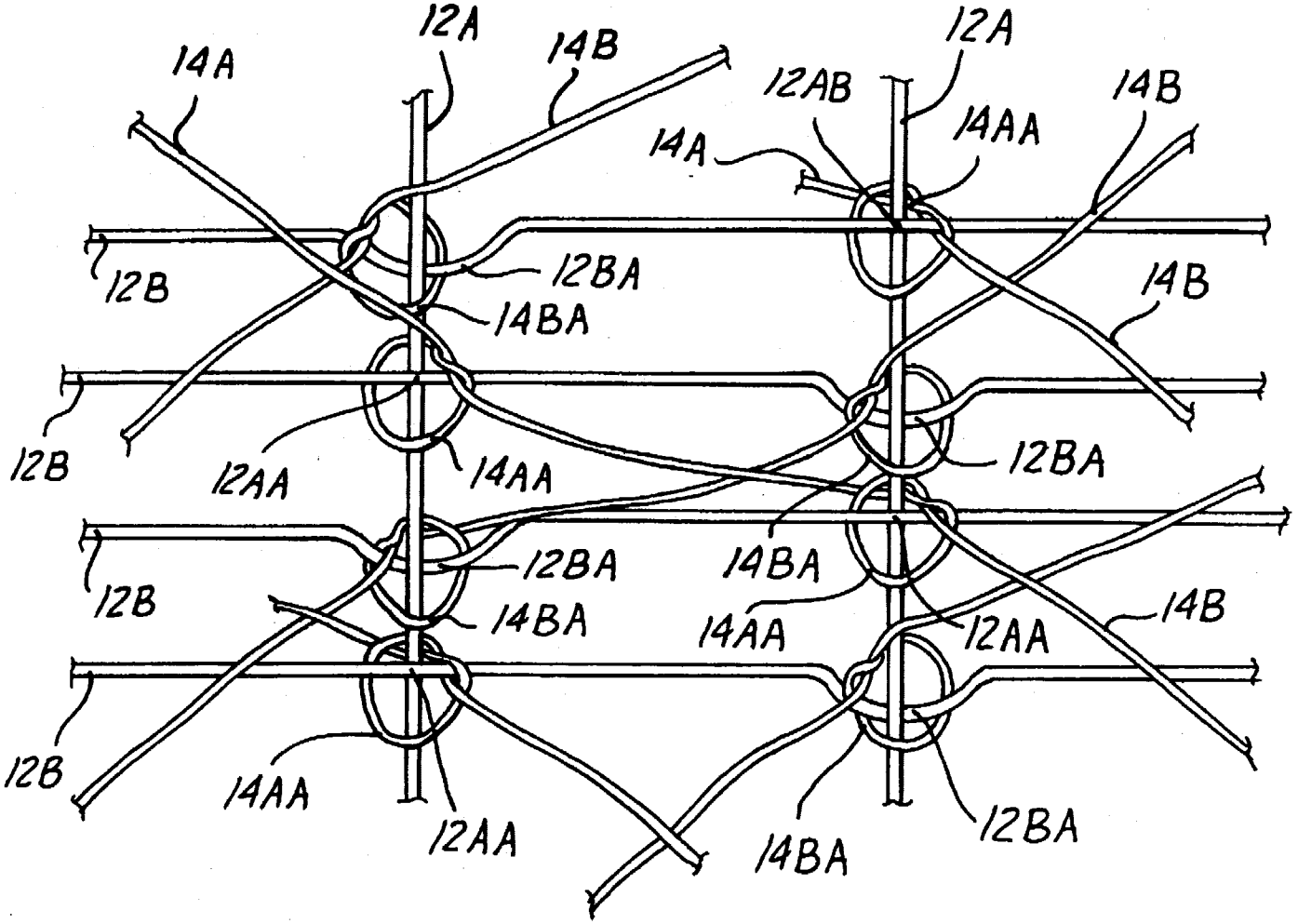
FIG. 5 is a magnified view of the cushioning material cross-weaved into the normal weave of the nylon showing the weave pattern.

Now, referring to FIG. 5 showing a magnified view of the comfort material cross-weaved into the normal weave of the nylon showing the weave pattern, exhibiting the following features: nylon stocking vertical threads 12A weaving in a basket-weave motion between the nylon stocking vertical threads upper crossing 12AA and the nylon stocking horizontal threads upper crossing 12BA; nylon stocking vertical threads under crossing 12AA weaving under the nylon stocking horizontal threads 12B forming a basket-weave pattern; nylon stocking horizontal threads 12B weaving in a basket-weave motion between the nylon stocking vertical threads upper crossing 12AA and the nylon stocking horizontal threads upper crossing 12BA; nylon stocking horizontal threads under crossing 12BA weaving under the nylon stocking vertical threads 12A forming a basket-weave pattern; stocking sole left diagonal threads 14A traversing diagonally upward in a right to left direction integrally weaving with the nylon stocking vertical threads 12A and nylon stocking horizontal threads 12B; stocking sole left diagonal threads loop crossing 14AA fastening the stocking sole left diagonal threads 14A to the nylon stocking vertical threads 12A and the nylon stocking horizontal threads 12B at the nylon stocking vertical threads under crossing 12AA; stocking sole right diagonal threads 14B traversing diagonally upward in a left to right direction integrally weaving with the nylon stocking vertical threads 12A and nylon stocking horizontal threads 12B; and stocking sole right diagonal threads loop crossing 14BA fastening the stocking sole right diagonal threads 14B to the nylon stocking vertical threads 12A and the nylon stocking horizontal threads 12B at the nylon stocking horizontal threads under crossing 12BA.

Figure 6:
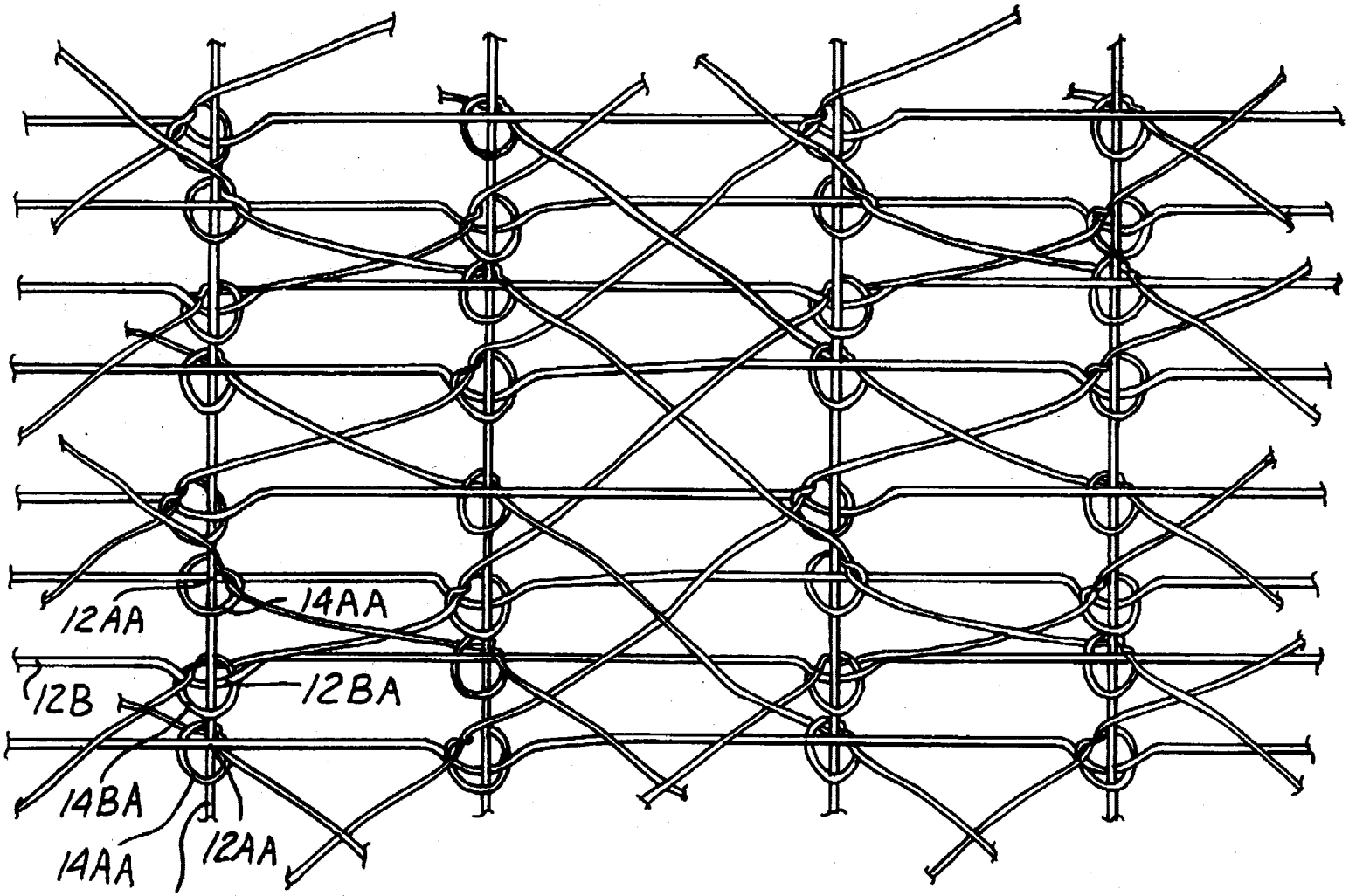
FIG. 6 is a lesser magnified view of the cushioning material cross-weaved into the normal weave of the nylon showing the weave pattern.

Lastly, referring to FIG. 6 being a lesser magnified view of the comfort material cross-weaved into the normal weave of the nylon showing the weave pattern, exhibiting the following features: nylon stocking vertical threads 12A weaving in a basket-weave motion between the nylon stocking vertical threads upper crossing 12AA and the nylon stocking horizontal threads upper crossing 12BA; nylon stocking vertical threads under crossing 12AA weaving under the nylon stocking horizontal threads 12B forming a basket-weave pattern; nylon stocking horizontal threads 12B weaving in a basket-weave motion between the nylon stocking vertical threads upper crossing 12AA and the nylon stocking horizontal threads upper crossing 12BA; nylon stocking horizontal threads under crossing 12BA weaving under the nylon stocking vertical threads 12A forming a basket-weave pattern; stocking sole left diagonal threads loop crossing 14AA fastening the stocking sole left diagonal threads 14A to the nylon stocking vertical threads 12A and the nylon stocking horizontal threads 12B at the nylon stocking vertical threads under crossing 12AA; stocking sole right diagonal threads loop crossing 14BA fastening the stocking sole right diagonal threads 14B to the nylon stocking vertical threads 12A and the nylon stocking horizontal threads 12B at the nylon stocking horizontal threads under crossing 12BA. The stocking has a stocking sole being constructed from a group of materials individually and in combination such as cotton, cotton-blend, wool, fleece and synthetic fibers.

The diagonal threads, stocking sole left diagonal threads 14A stocking and sole right diagonal threads 14B, are incorporated into the nylon stocking horizontal threads 12B and nylon stocking vertical threads 12A threads to form a knot, stocking sole left diagonal threads loop crossing 14AA and stocking sole right diagonal threads loop crossing 14BA, by first manufacturing a standard box thread utilizing nylon thread as the nylon stocking horizontal threads 12B and nylon stocking vertical threads 12A and thereafter in the comfort areas weaving diagonal threads, stocking sole left diagonal threads 14A stocking and sole right diagonal threads 14B, which are constructed from a softer and more absorbent material such as cotton, cotton-blend, wool, fleece and synthetic fibers. These diagonal threads, stocking sole left diagonal threads 14A stocking and sole right diagonal threads 14B, are interwoven in a diagonal pattern from lower left to upper right (or upper right to lower left) through the diagonal boxes formed by standard box weaving of the nylon stocking horizontal threads 12B and nylon stocking vertical threads 12A. At each junction, nylon stocking horizontal threads under crossing 12BA, which is on a lower left to upper right (or upper right to lower left) of the nylon stocking horizontal threads 12B and nylon stocking vertical threads 12A threads a simple knot is tied to secure the nylon stocking horizontal threads 12B to both the nylon stocking horizontal threads 12B and nylon stocking vertical threads 12A threads. Thereafter, perpendicular stocking sole left diagonal threads 14A are interwoven in a diagonal pattern from lower right to upper left (or upper left to lower right) through the diagonal boxes formed by standard box weaving of the nylon stocking horizontal threads 12B and nylon stocking vertical threads 12A threads. At each junction, nylon stocking vertical threads under crossing 12AA, which is on a lower right to upper left (or upper left to lower right) of the nylon stocking horizontal threads 12B and nylon stocking vertical threads 12A, a simple knot is tied to secure the stocking sole left diagonal threads 14A to both the nylon stocking horizontal threads 12B and nylon stocking vertical threads 12A threads.

It will be understood that each of the elements described above, or two or more together, may also find a useful application in other types of constructions differing from the type described above.

While the invention has been illustrated and described as embodied in a stocking having a comfort foot area, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A sock having a comfort foot area (10) comprising:

A) a nylon stocking (12) having a plurality of nylon stocking vertical threads (12A) and a plurality of nylon stocking horizontal threads (12B) in a standard box weaved over and under pattern forming junction points therebetween; and B) a stocking sole (14) positioned at a bottom of the nylon stocking (12), the stocking sole (14) comprises a plurality of stocking sole left diagonal threads (14A) and a plurality of stocking sole right diagonal threads (14B), the stocking sole left diagonal threads (14A) have stocking sole left diagonal thread loop crossings (14AA) which are simple knots positioned at each diagonal junction point affixing the stocking sole left diagonal threads (14A) to the nylon stocking vertical threads (12A) and the nylon stocking horizontal threads (12B) in a junction region, stocking sole right diagonal threads (14B) have stocking sole right diagonal thread loop crossings (14BA) each of which is a simple knot affixing the stocking sole right diagonal threads (14B) to the nylon stocking vertical threads (12A) and the nylon stocking horizontal threads (12B) in a second junction region, the stocking sole (14) functions as a comfort foot area.

2. The stocking having a comfort foot area (10) as described in claim 1, wherein the comfort foot area covers an area of the stocking selected from a group consisting of toe, sole and heel.

3. The stocking having a comfort foot area (10) as described in claim 1, wherein the stocking sole left diagonal threads (14A) and the stocking sole right diagonal threads (14B) are constructed from a group of materials consisting of cotton, cotton-blend, wool, fleece and synthetic fibers.

* * * * *